US005337704A

United States Patent [19]

Roth

[11] Patent Number: 5,337,704

[45] Date of Patent: Aug. 16, 1994

[54] ENGINE COOLING SYSTEM WITH THERMOSTAT COOLANT FLOW CONTROL BETWEEN HEAD AND BLOCK

[75] Inventor: David B. Roth, Bloomfield, Mich.

[73] Assignee: Chrysler Corporation, Highland Park, Mich.

[21] Appl. No.: 128,181

[22] Filed: Sep. 29, 1993

[51] Int. Cl.[5] ..... F01P 7/14

[52] U.S. Cl. ..... 123/41.1; 123/41.29

[58] Field of Search ..... 123/41.1, 41.29, 41.09, 123/41.08

[56] References Cited

U.S. PATENT DOCUMENTS

| | | | |
|---|---|---|---|
| 3,981,279 | 9/1976 | Bubniak et al. | 123/41.14 |
| 4,212,270 | 7/1980 | Nakanishi et al. | 123/41.09 |
| 4,423,705 | 1/1984 | Morita et al. | 123/41.02 |

FOREIGN PATENT DOCUMENTS 54-20248 2/1979 Japan .

OTHER PUBLICATIONS

S.A.E. C427/84, "A study on dual circuit cooling for higher compression ratio", pp. 151–157, 1984.

S.A.E. C443/84. "Torque characteristics and fuel efficiency of various gasoline engine concepts", pp. 41–46, 1984.

*Primary Examiner*—Noah P. Kamen

*Attorney, Agent, or Firm*—Kenneth H. MacLean, Jr.

[57] ABSTRACT

An improved cooling system for an internal combustion engine in an automotive vehicle which utilizes recirculating liquid coolant and provides an initial engine warm-up flow circuit extending: from a coolant pump, through cooling passages in the cylinder head, through a heat exchanger used to warm a passenger compartment, and back to the pump whereby a temperature responsive flow control valve or thermostat prohibits a flow of coolant from the cylinder head to cooling passages in the engine block which provides adequate cooling of the upper surfaces of the combustion chamber which are formed by the cylinder head while promoting a relatively rapid heating of the surfaces of the engine cylinders formed by the block. After the warm-up period, the thermostat opens to permit coolant flow into a down-flow passage between the cylinder head coolant passages and the engine block coolant passages resulting in a normal engine cooling circuit extending: from the coolant pump, through the cylinder head cooling passages, then through the engine block cooling passages, through a vehicle radiator, and back to the coolant pump. The improved cooling system actively cools the upper surfaces of the combustion chamber formed by the cylinder head both during an engine warm-up period and during normal engine operation which promotes complete combustion of the fuel and inhibits knock and pre-ignition.

2 Claims, 2 Drawing Sheets

ENGINE COOLING SYSTEM WITH THERMOSTAT COOLANT FLOW CONTROL BETWEEN HEAD AND BLOCK

BACKGROUND OF THE INVENTION

1. Field of the Invention

This invention relates to a new and improved cooling system using liquid coolant for an internal combustion powered vehicle, and more particularly, to an improved cooling system having an engine warm-up mode with a flow circuit extending: from a coolant pump, then through coolant passages in the cylinder head, through a passenger compartment heat exchanger, and back to the pump whereby flow through coolant passages in the engine block are prevented which isolates these passages to reduce the period of time for warming-up the engine while heat is quickly available for heating the vehicle passenger compartment. After the engine is warmed-up, a single thermostatic control valve located across a down-flow passage between the cylinder head and engine block passages opens in response to increased temperature of coolant in the cylinder head to direct the flow of coolant from the cooling passages of the cylinder head passages to the engine block passages and then through a radiator.

2. Description of Related Art

Prior to the present invention, engine cooling systems have been devised with various cooling circuit arrangements to improve operation of the engine as well as operation of associated units, such as the passenger compartment heater and an associated windowshield defroster.

In application 52-85309 published in Japan as document No. 54-20248 on Feb. 2, 1979, an engine cooling circulation system is disclosed in which a pair of thermostats are employed to isolate the cylinder block and radiator from coolant flow during initial engine operation so that heated coolant flows through the cylinder head and heater for quick warm-up of the passenger compartment.

In S.A.E publications C427/84 and C443/84, both copyrighted in 1984, dual and separate coolant circuits for the cylinder head and engine block are disclosed with the head and block cooled at different coolant temperatures and with reported improved engine performance. The coolant in the cylinder head circuit is maintained at a lower temperature than the engine block coolant to reduce surface temperatures of the combustion chamber so that the fuel mixture burns smoothly and knock is reduced. Lower octane fuel is also tolerated. The higher coolant temperatures in the engine block are effective to keep friction losses low so that operating efficiency is enhanced.

In U.S. Pat. Nos. 4,212,270 and 4,423,705, dual coolant pumps and dual cooling system are disclosed to separately cool the block and the cylinder head.

U.S. Pat. No. 3,981,279 discloses an engine cooling system with a single thermostat with coolant flow from a pump into passages in the engine block, through passages in the cylinder head, through a radiator, and then back to the pump. In this sequential flow system, the advantages of a down-flow system, such as in the present invention, are not obtained. The thermostat controller opens at an elevated temperature to allow coolant to flow from the cylinder head back to the radiator to control the temperature level of the coolant in the block and the head at the same temperature.

SUMMARY OF THE INVENTION

This invention is directed to a new and improved system with liquid coolant for cooling an internal combustion engine and including a regulated down-flow coolant passage extending between cooling passages in the cylinder head and cooling passages in the engine block. The coolant temperature and flow characteristics in both the engine block passages and in the cylinder head passages is regulated and controlled by a single thermostat. The thermostat is strategically installed in the down-flow coolant passage between the cylinder head and engine block passages. During an engine warm-up period, coolant in the block passages is isolated from the head passages to shorten the warm-up period. During an engine warm-up period, the cylinder head is cooled by flow through the passages therein to control surface temperatures of the combustion chamber formed by the cylinder head to prevent knock and to provide a source of warmed coolant for heating the passenger compartment. Also, the corresponding lack of coolant flow through the engine block passages during engine warm-up, more quickly heats up the lower surfaces of the cylinders which promotes complete combustion of fuel. After the engine warm-up period, the increased coolant temperature causes the thermostat to open so that coolant can flow through the down-flow passage from the cylinder head cooling passages to the engine block cooling passages and then through the vehicle radiator.

More particularly and in contrast to the above noted prior art disclosures, the engine cooling circuitry of this invention is readily adaptable to existing and new generation engines. It uses a single thermostat positioned to control coolant flow through a down-flow passage between the cylinder head and the engine block. During a warm-up mode after starting the engine and before the temperature of coolant reaches normal operating temperatures, a closed thermostat directs coolant flow only through cooling passages in the cylinder head and a heater for the passenger compartment and not through cooling passages in the engine block nor through a vehicle radiator. This warm-up circuit decreases the warm-up period for the cylinder head and its connected intake manifold and other air/fuel supply components which also permits shortening the period of a special cold start/rich mixture program. Also, the warm-up circuit only through the cylinder head and heater controls the surface temperature of upper portions of the combustion chambers formed by the cylinder head to thereby inhibit knock and formation of nitrogen oxides. The warm-up circuit also promotes relatively rapid warm-up of the lower cylinder surfaces formed in the engine block which promotes complete combustion and supresses hydrocarbon emissions. Thus, both fuel economy and hydrocarbon emission performance are improved. Further, the warm-up circuit quickly warms coolant for use to heat a passenger compartment and to defrost a windshield.

After a predetermined normal operating coolant temperature is attained, the thermostat opens to allow coolant flow into the engine block passages through the down-flow passage and adds the vehicle radiator to the cooling circuit. The advantages of the subject regulated down-flow system are a reduction in: the quantity of engine coolant required for effective engine operation, engine knock, fuel octane levels, coolant flow rates and exhaust emissions.

These and other features, object and advantages will become more apparent from the following:

DETAILED DESCRIPTION

Figure 1:
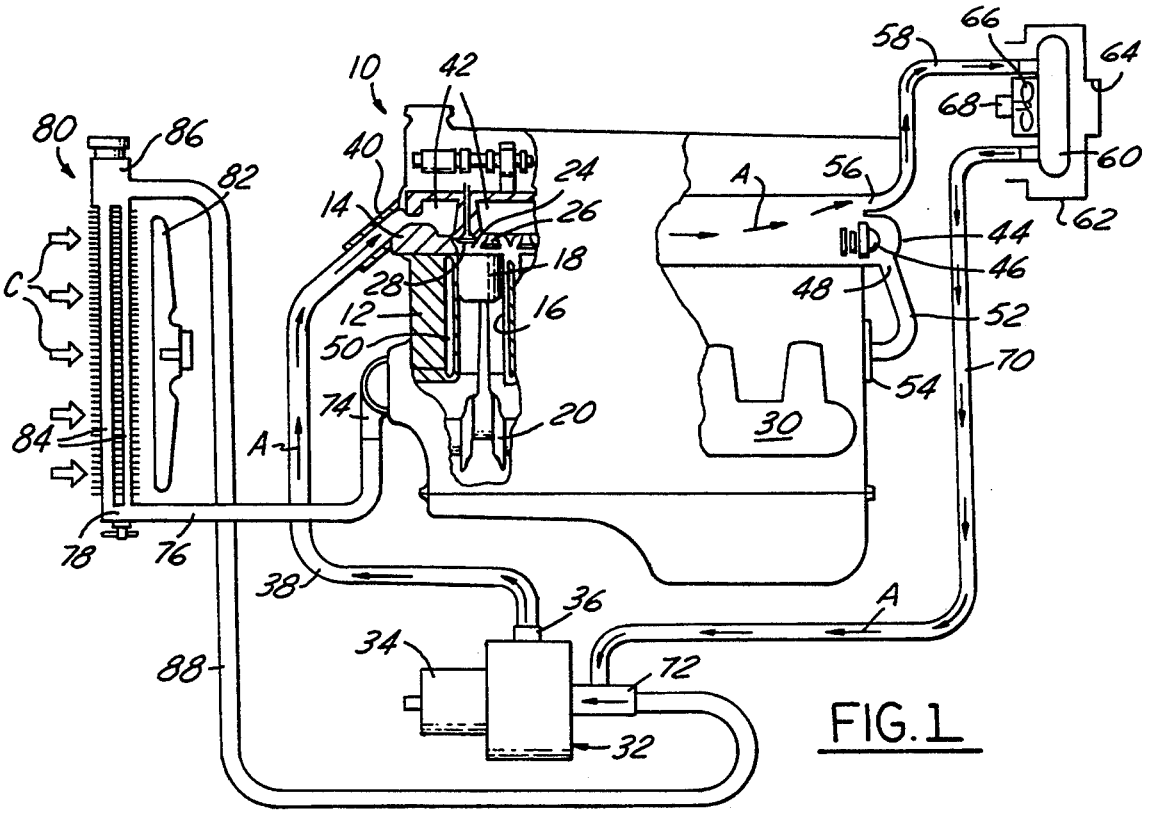
FIG. 1 is a somewhat diagrammatic side elevational view of an engine and engine cooling system with portions broken away for clarity and in an engine warm-up mode of operation.
Figure 2:
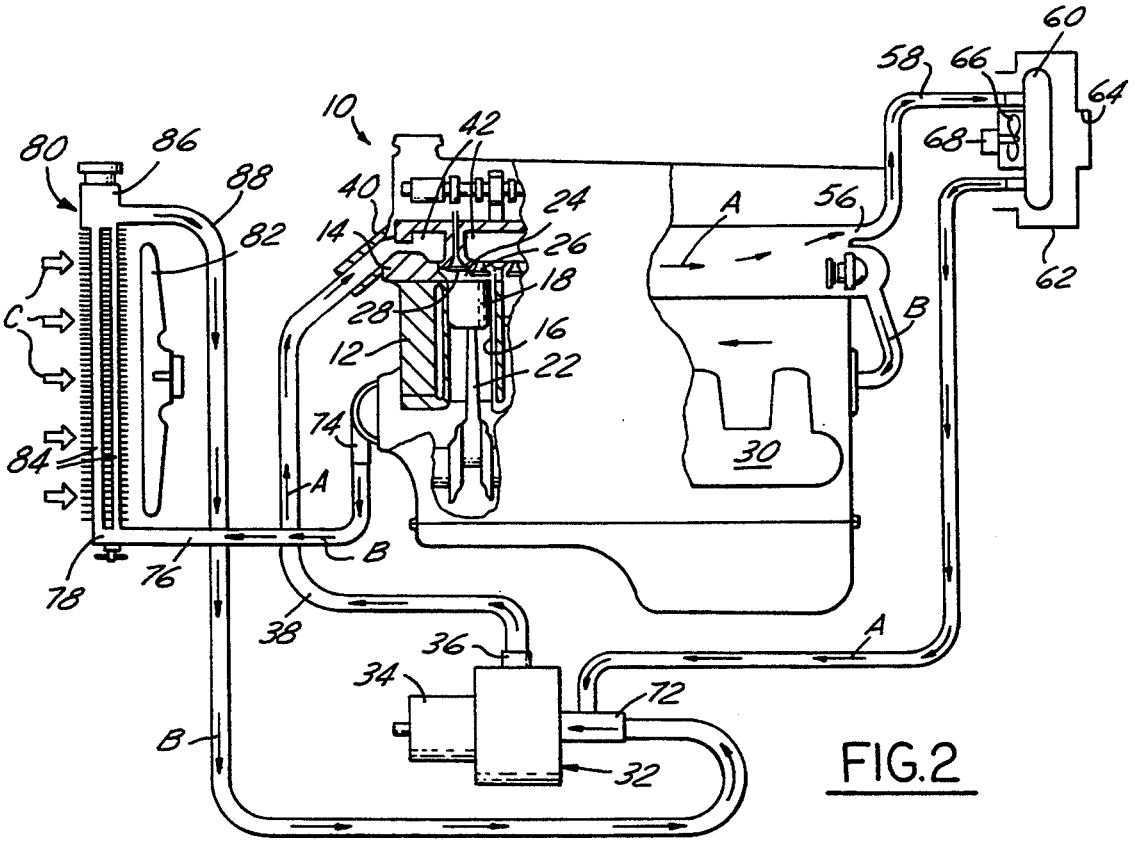
FIG. 2 is a view similar to that of FIG. 1 illustrating a normal operating mode of operation of the engine and cooling system.
Figure 3:
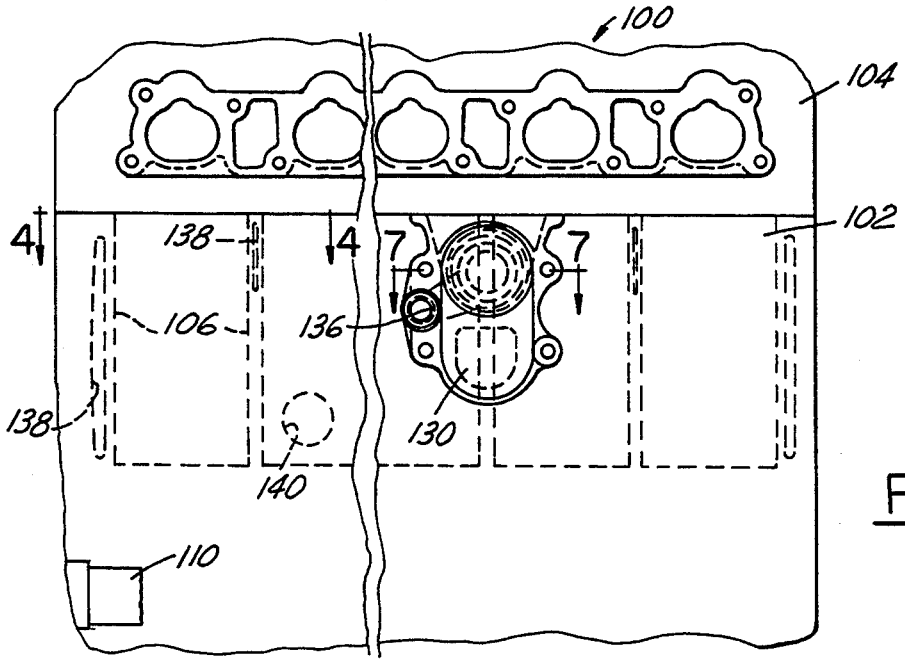
FIG. 3 is a partial elevational side view of a second embodiment of an engine with the subject cooling system.

Turning now in greater detail to the first embodiment of the invention illustrated in FIGS. 1 and 2, an internal combustion engine 10 for an automotive vehicle is somewhat diagrammatically shown. Engine 10 includes an engine block 12 to which a cylinder head 14 is secured in a known manner by threaded fasteners, not shown.

The engine block is bored to provide cylinders 16 for receiving pistons 18 (one shown) that are mounted for reciprocating movement therein. Each piston is operatively connected in a known manner to a crankshaft 20 by a connecting rod 22 so that a downward power stroke of the piston turns the crankshaft providing engine output. The cylinder head 14 has shaped upper chambers each align with the cylinders. Each chamber associated with a cylinder and piston therein defines a combustion chamber 24. An air/fuel mixture is allowed to enter the combustion chamber 24 past an opened intake valve 26 as piston 18 moves downward in cylinder 16. Next, the air/fuel mixture is compressed by upward movement of the piston. Then a spark plug (not shown) ignites the air/fuel mixture all as known in the engine art.

The air/fuel mixture in combustion chamber 24 expands as it is combusted causing the piston to move downward. Subsequently, as the piston moves upward again, an opened exhaust valve 28 allows exhaust gasses to be forced out of the combustion chamber 24 into an exhaust manifold 30 which is part of an exhaust system (remainder not shown).

The improved cooling for the internal combustion engine is provided by a down-flow liquid coolant system including a fluid pump 32 anchored to the block of the engine. This pump 32 can be a conventional engine driven type or an electrically driven type by a motor 34. The pump has a discharge fitting 36 connected to the cylinder head 14 by a fluid coolant supply line 38. The line 38 connects with head 14 through a tubular fitting 40 associated with the end of cylinder head 14. Fitting 40 fluidly connects the line 38 and the pump 32 with the coolant passages 42 within cylinder head 14. A thermostat housing 44 is located at an opposite end of cylinder head 14 relative to fitting 40. Housing 44 encloses a thermostat 46 which is positioned in a down-flow coolant passage 48 which connects cylinder head passages 42 with coolant passages 50 within the engine block 12. In one mode, the thermostat 46 blocks coolant flow from the cylinder block passages 42 to the engine block passages 50. In another mode, the thermostat 46 permits coolant to flow from the passages 42 into passages 50. The flow is regulated in correspondence to the temperature of the coolant. The down-flow passage 48 in this embodiment includes a hose or pipe 52 connected to an outlet of housing 44 and to an inlet fitting 54 which communicates with coolant passages 50.

The thermostat 50 is of conventional design with a valve element which normally seats in a closed operative position to block coolant flow from passages 42 to passages 50 during a warm-up mode of operation when coolant temperature is below a predetermined start-to-open temperature. During this warm-up mode, the down-flow passage 48 is therefore blocked and coolant can only flow from the cylinder head passages 42 through a heater discharge passage 56 connected to the cylinder head passages 42. A pipe or hose 58 connects the cylinder head passages 42 and passage 56 with a heat exchanger core or heater 60 used to heat passenger compartment air.

The passenger compartment heater 60 is mounted in a housing 62 which has a discharge opening 64 for directing heated air into the passenger compartment for compartment heating and/or onto the windshield for defrosting. A blower or fan 66 driven by an electric motor 68 forces air through the heater 60. A coolant return line or hose 70 connects the outlet of the heater 60 to an inlet fitting 72 of pump 32 to complete the warm-up circuit for coolant flow illustrated by flow arrows A.

When thermostat 46 is closed, the coolant in the engine block coolant passages 50 is isolated so that there is no flow through the engine block. Under these no-flow conditions, the cylinder walls 16 are rapidly heated to quickly eliminate any cold surfaces which would promote undesirable formation and emission of unburnt hydrocarbons.

Furthermore, since coolant can flow through the cylinder head even when the thermostat is closed, the surfaces which define the upper portions of the combustion chamber 24 are effectively cooled. Resultantly, combustion and fuel economy are improved and the engine is less sensitive to lower octane gasoline and a tendency to knock.

Subsequent to the above described warm-up mode, coolant in the cylinder head passages 42 reaches a predetermined start-to-open temperature of the thermostat, such as 180 degrees Fahrenheit. Consequently, thermostat 46 begins to open so that coolant can flow from the cylinder head passages 42 through the down-flow passage 48 and into the engine block passages 50, as shown by flow arrows B in FIG. 2. Coolant then circulates about the engine's cylinders 16 in the engine block to provide the advantage of a liquid coolant recirculating system with high specific heat capacity and good thermal transition from the block.

A fitting 74 associated with the engine block passages 50 provides an outlet for coolant from block passages 50. The coolant then flows through a line or hose 76 into the inlet side tank 78 of a radiator 80. The radiator 80 receives a flow of air as shown by arrows C which results from either vehicle movement or a fan 82. Fan 82 may be driven directly by the engine or by an electric motor (not shown). Coolant first passes through finned tubes 84 from the inlet side tank 78 to an outlet side tank 86. From outlet side tank 86, the coolant flows from radiator 80 through connecting line or hose 88 back to the pump 32. Line 88 is attached to the pump's inlet fitting 72. This completes the incorporation of coolant flow through the engine block passages 50 and radiator 80 to the cooling circuit as shown by arrows B.

A second embodiment of the invention is shown in FIGS. 3–7 which mainly concerns a desirable arrangement of the flow directing means between the cylinder head passages 42, the engine block passages 50, and the heater 60. For simplicity, some of the associated structure shown in FIGS. 1 and 2 such as the heater 60 or the radiator 80 are not shown in FIGS. 3–7. However, these associated portions of the entire cooling system in FIGS. 1–2 are applicable to the second embodiment but are merely not shown.

Figure 4:
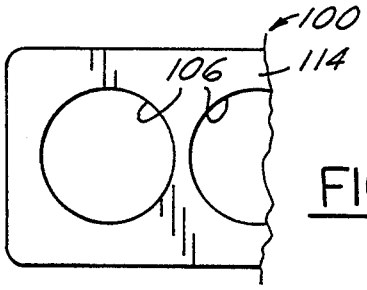
FIG. 4 is a sectioned view taken along section line 4—4 in FIG. 3 and looking in the direction of the arrows.
Figure 5:
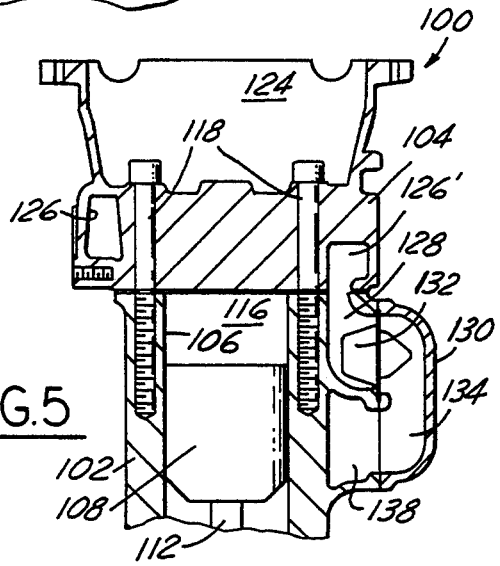
FIG. 5 is a view taken along section line 5—5 in FIG. 3 and looking in the direction of the arrows.
Figure 6:
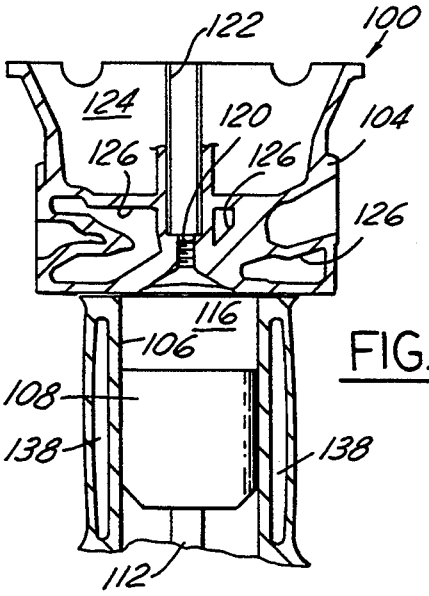
FIG. 6 is a view taken along section line 6—6 in FIG. 3 and looking in the direction of the arrows.
Figure 7:
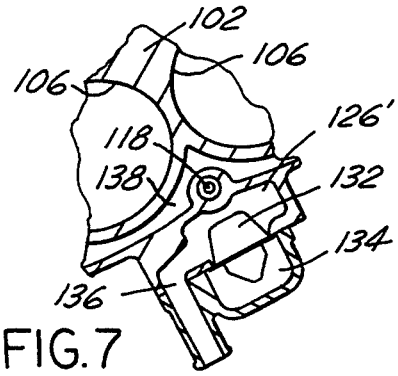
FIG. 7 is a view taken along section line 7—7 in FIG. 3 and looking in the direction of the arrows.

An engine 100 is shown in FIGS. 1–2 which includes an engine block 102 and a cylinder head 104. Cylinders 106 are formed in the engine block 102 as best shown in FIGS. 4, 5, and 6. A reciprocally mounted piston 108 is positioned in each cylinder 106. Each of the pistons 108 is connected to a crankshaft 110 (see FIG. 3) by a connecting rod 112. Cylinder head 104 covers the upper end 114 of the block 102 to define combustion chambers 116 in association with the cylinders 106 and the pistons 108. In FIG. 5, bolts 118 attach cylinder head 104 to the block 102. As with the engine shown in FIGS. 1 and 2, the engine 100 includes intake and exhaust valves and an exhaust manifold (not shown). For each cylinder, a centrally located threaded hole 120 is adapted to receive a spark plug (not shown). A spark plug tube 122 is provided to receive the spark plug and separate it from the interior 124 of the cylinder head which normally encloses camshafts, valve lifters and other associated valve train components (not shown).

The engine 100 has a fluid pump (not shown) which can be like pump 32 in FIGS. 1 and 2 but is preferably driven by the crankshaft 110 as is conventional. This pump is connected by a conventional coolant line or hose to coolant passages 126 in cylinder head 104 which are best seen in FIGS. 5 and 6. From the pump and outlet line, coolant enters cylinder head cooling passages 126. The coolant flows through passages 126 to a thermostat enclosure 128 formed by portions of the engine block 102, the cylinder head 104, and a removable thermostat cover 130. The enclosure 128 is positioned across the junction between the engine block 102 and cylinder head 104, preferably somewhere between the end portions of the engine. The location of both the inlet and the outlet (thermostat) can be selected to produce coolant flow either longitudinally through the cylinder head (end to end) or laterally across the cylinder head.

The enclosure 128 has an inlet passage 126' which is a termination of passages 126. A thermostat 132 is positioned adjacent the inlet passage 126' to receive coolant from the cylinder head 104. In the engine warm-up mode, the thermostat 132 blocks the flow of coolant from the passages 126 to a down-flow outlet passage 134 when the coolant in passage 126' is below a start-to-open temperature of the thermostat 132. However, coolant can flow into a heater outlet passage 136 which is connected to a heater for a passenger compartment as in the first embodiment of FIGS. 1 and 2. Then, in the warm-up mode, the coolant passes from cylinder head passages to the heater outlet passage 136 and to the heater before returning to the pump through a line or hose (not shown) extending form the heater to the pump.

After the warm-up mode which begins when the coolant temperature in passage 126' exceeds the start-to-open temperature of the thermostat, coolant flow is permitted through the down-flow passage 134 and into coolant passages 138 in the engine block 102. After passing through block passages 138, the coolant is discharged from the engine through an outlet passage and fitting 140 positioned at the opposite side of the engine block as the enclosure 128. Then a line or hose (not shown) carries the coolant back to the inlet of the pump.

While preferred embodiments of the invention has been shown and described, other embodiments will now become apparent to those skilled in the art. Accordingly, this invention is not to be limited to what is shown and described but by the following claims.

What is claimed is:

1. An improved cooling system for an internal combustion engine having an engine block with a liquid coolant flow passage therein, a cylinder head secured to said engine block and with a liquid coolant flow passage therein separate from said engine block flow passage, a pump with an inlet and an outlet for producing coolant flow, coolant passage means connecting said pump inlet to said cylinder head flow passage so that coolant is first passed through said cylinder head flow passage, a radiator with an inlet and outlet, a heat exchanger for warming a passenger compartment, return passage means connecting said heat exchanger to said pump, normally closed thermostatic means operatively associated with said cylinder head flow passage to block coolant flow from said cylinder head flow passage into said engine block flow passage during an engine warm-up mode of operation whereby coolant flows from the cylinder head flow passage soley to said heat exchanger and then back to said pump, passage means connecting said engine block flow passage to said radiator inlet and return passage means connecting said radiator outlet to said inlet of said pump, said thermostatic means opening in response to an increased coolant temperature to permit coolant to flow from said cylinder head flow passage to said engine block flow passage whereby coolant flows first through said cylinder head flow passage and then through either said engine block flow passage and said radiator or through said heat exchanger.

2. An improved cooling system for an internal combustion engine comprising: an engine block having a plurality of discrete cylinders therein, a piston operatively mounted in each of said cylinders for reciprocal stroking movements, a coolant flow passage extending through said engine block and adjacent to said cylinders from a coolant inlet to a coolant outlet, a cylinder head operatively attached to said engine block and having a plurality of portions which respectively correspond to and cooperate with said cylinders to define a plurality of combustion chambers, a coolant flow passage extending through said cylinder head and adjacent to said combustion chambers, said coolant flow passage having a coolant inlet and first and second coolant outlets, a pump with a coolant inlet and outlet, first passage means connecting said pump outlet with said coolant inlet in said cylinder head, second passage means operatively connecting said first coolant outlet in said cylinder head to the coolant inlet to said engine block, a first heat exchanger with an inlet and an outlet, third coolant passage mean operatively connecting said second coolant outlet in said cylinder head to said inlet of said first heat exchanger, a fourth coolant passage means operatively connecting said outlet of said first heat exchanger to said pump inlet, a second heat exchanger with an inlet and an outlet, a fifth fluid passage means operatively connecting said coolant outlet of said engine block to said inlet of said second heat exchanger, a sixth coolant passage means operatively connecting said outlet of said second heat exchanger to said pump inlet, a thermostatically controlled valve operatively connected to said second passage means to inhibit coolant flow from said cylinder head flow passage to said engine block during an engine warm-up mode whereby the time period to heat said engine block and said cylinders to a point which inhibits hydrocarbon formation on the surfaces defining said cylinders so that hydrocarbon emissions from combustion are minimized is decreased, said thermostatically controlled valve opening to allow flow from said cylinder head flow passage through said engine block flow passages in response to an increased coolant temperature so that the operating temperature of said engine is controlled by coolant flow through said second heat exchanger.

* * * * *